United States Patent [19]

Brown

[11] 4,306,390

[45] Dec. 22, 1981

[54] RECREATIONAL VEHICLE ENCLOSURE

[76] Inventor: Maurice L. Brown, 11863 Stark Rd., Livonia, Mich. 48150

[21] Appl. No.: 79,332

[22] Filed: Sep. 27, 1979

[51] Int. Cl.[3] ..... E04B 1/343

[52] U.S. Cl. ..... 52/67; 52/66; 52/DIG. 14; 52/64

[58] Field of Search ..... 52/67, 66, 64, DIG. 14

[56] References Cited

U.S. PATENT DOCUMENTS

| | | | |
|---|---|---|---|
| 1,572,790 | 2/1926 | Grigsby | 52/67 |
| 2,757,041 | 7/1956 | Alcorn | 296/100 |
| 3,165,352 | 1/1965 | Hallock et al. | 296/100 |
| 3,180,674 | 4/1965 | Pounds | 296/100 |
| 3,201,171 | 8/1965 | Wickard | 296/100 |
| 3,367,073 | 2/1968 | Seeger et al. | 52/66 |
| 3,797,178 | 3/1974 | Mule | 52/66 |

FOREIGN PATENT DOCUMENTS

| | | | |
|---|---|---|---|
| 866845 | 2/1953 | Fed. Rep. of Germany | 52/64 |
| 233109 | 5/1925 | United Kingdom | 52/66 |
| 1123791 | 8/1968 | United Kingdom | 52/67 |

*Primary Examiner*—Alfred C. Perham

*Attorney, Agent, or Firm*—Gifford, VanOphem, Sheridan & Sprinkle

[57] ABSTRACT

A recreational vehicle enclosure comprising a base, a first housing portion pivotally secured to the base and a second housing portion pivotally secured to the base about the same pivotal axis. The second housing portion is appropriately dimensioned so as to be telescopically retracted within the first housing portion when either housing portion is pivoted from a first pivotal position to a second pivotal position. A sealant is preferably disposed around the open ends of each housing portion to weatherproof the enclosure.

4 Claims, 3 Drawing Figures

RECREATIONAL VEHICLE ENCLOSURE

BACKGROUND OF THE INVENTION

I. Field of the Invention

The present invention relates generally to enclosures for storing recreational vehicles and more particularly to such an enclosure having a base and two housing portions pivotally secured to the base so that as either one of said housing portions pivots, a first housing portion is telescopically received in a second housing portion.

II. Description of the Prior Art

Recreational vehicles such as snowmobiles or motorcycles have enjoyed increased popularity and provide great enjoyment when ridden in specially provided recreational areas or along trails or open areas. Nevertheless, it is often necessary for urban dwellers to travel great distances in order to find such recreational areas or open spaces. Thus, it is necessary to transport the recreational vehicles by trailer or the like between urban areas and recreational areas.

A common method of transporting these vehicles merely consists of securing the vehicle to an open flat bed trailer or truck bed by chains or the like. Although such a method is inexpensive and effectively retains the vehicle on the trailer or truck bed, the installation of chains or other locking members can be time-consuming, especially when attempting to ensure that the chain will not become slack from repeated vibration, road bumps, or wind forces. In addition, such a method leaves the recreational vehicle exposed to weather conditions as well as debris which is thrown up by the tires of passing motorists.

Although some previously-known recreational vehicle covers are now available, these covers are often made of a cloth or plastic material. Some of these covers are stretched over the recreational vehicle and then secured at appropriate spots along the truck or trailer bed. Thus, installation of these covers is somewhat complicated and time-comsuming. Moreover, they include large gaps between anchoring points of the cover through which the vehicle is still exposed to weather conditions and road debris. Still others of these pliable covers are patterned with a configuration of the recreational vehicle so as to completely enclose the recreational vehicle with the cover. However, these covers are disadvantageous in that they do not protect the vehicle from the impact of large rocks or stones thrown up by passing vehicle tires. Moreover, since these covers are flexible, they are difficult to wrap around and secure around the instruments or parts protruding from the main body of the recreational vehicle.

SUMMARY OF THE PRESENT INVENTION

The present invention overcomes the above-mentioned disadvantages by providing a rigid walled recreational vehicle enclosure which can be placed on or secured to a flat trailer or truck bed. The enclosure of the present invention provides easy entrance and exit of the recreational vehicle from within the enclosure. In addition, the enclosure completely protects the recreational vehicle from weather conditions, road debris, or other projectiles.

The enclosure of the present invention generally comprises a substantially flat base and two partially enclosed housing portions. Both housing portions are pivotally secured to the base around a single pivotal axis although the housing portions extend along the base in opposite directions from said single pivotal axis when said housing portions are in a first pivotal position. In this first pivotal position, the device of the present invention provides a completely enclosed chamber in which recreational vehicles can be stored.

When one of said housing portions is moved to its second pivotal position, one of the housing portions is telescopically received in the other housing portion. When one of the housing portions is in its second pivotal position, the base is only partially enclosed by the two housing portions.

Preferably, each housing portion is provided with a handle for pivoting that section relative to the base and the other housing portion. In addition, locking means are preferably provided for each housing portion so that each housing portion can be locked in its first pivotal position. In addition, sealing means are preferably provided around each open side of each housing portion to provide a weatherproof, completely enclosed storage device.

BRIEF DESCRIPTION OF THE DRAWING

The present invention will be more clearly understood by reading the following detailed description in conjunction with the accompanying drawing, in which like reference characters refer to like parts throughout the several views and in which.

DETAILED DESCRIPTION OF THE PRESENT INVENTION

Figure 1:
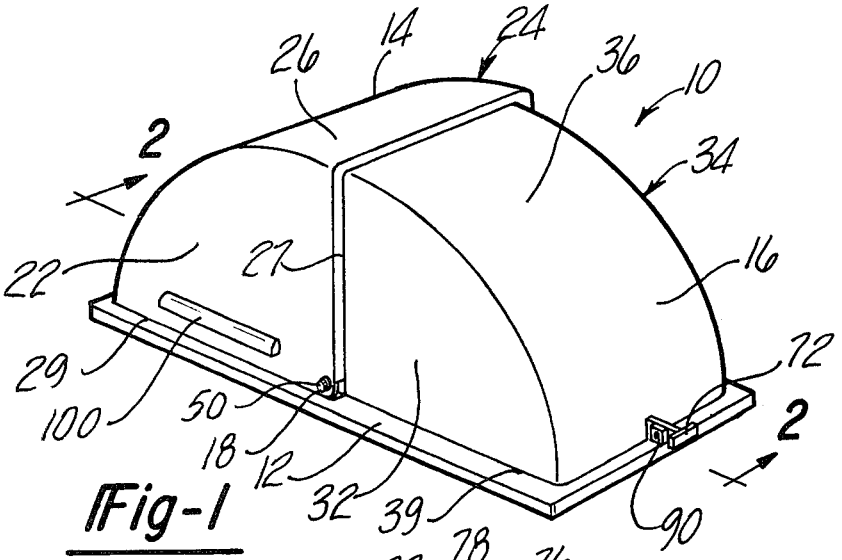
FIG. 1 is a perspective view of the vehicle enclosure of the present invention.

Referring now to FIG. 1, the recreational vehicle enclosure of the present invention is thereshown comprising a substantially flat base 12, a first housing portion 14, and a second housing portion 16. The housing portions 14 and 16 are pivotally secured to the base 12 around a single pivotal axis 18. The base 12 is made of a rigid material so as to be able to support the housing portions 14 and 16 as well as a vehicle or other article which is stored within the enclosure 10. The housing portions 14 and 16 are also constructed of a rigid material so as to retain their original shape despite exposure to weather conditions and flying debris.

The first housing portion 14 has a pair of sector-shaped side walls 22 and 24 which are spaced apart but interconnected by means of a top wall 26 secured along each arcuate edge of the sector-shaped side walls 22 and 24. Similarly, the second housing portion 16 has sector-shaped side walls 32 and 34 which are spaced apart but connected together by a top wall 36 secured along the arcuate edge of each sectorshaped side wall 32 and 34. However, the dimensions of side walls 32 and 34 and top wall 36 of housing portion 16 are appropriately down sized from the dimensions of the side walls 22 and 24 and top wall 26 of the first housing portion 14 so that the second housing portion 16 can be pivotally retracted within the first housing portion 14. Thus, when the housing portion 16 is pivoted around the axis 18, it pivotally retracts into the first housing portion 14. Moreover, when housing portion 16 is telescopically received in housing portion 14, a portion of the normally enclosed base is open.

Figure 3:
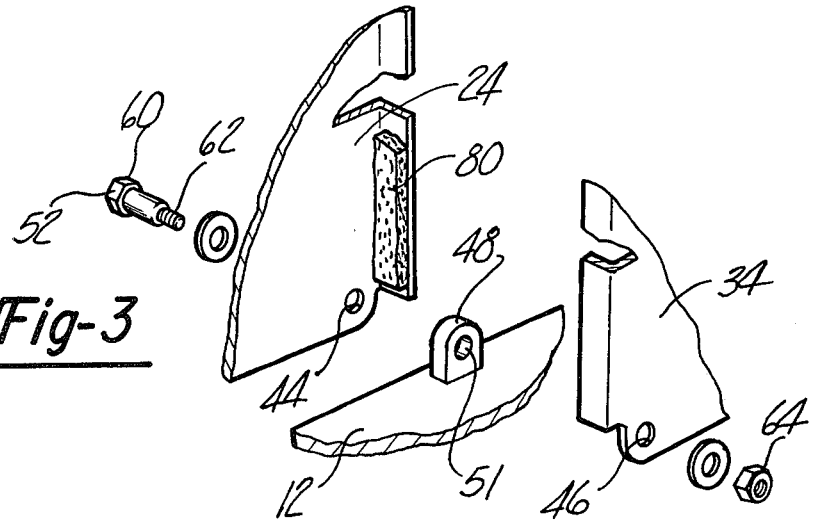
FIG. 3 is an exploded perspective view of a portion of the present invention shown in FIGS. 1 and 2.

The sector-shaped side wall and arcuate top wall construction provides the housing portion 14 with adjacent open ends 27 and 29. Similarly, the housing portion 16 is provided with adjacent open ends 37 and 39. The corner of side wall 22 adjacent the intersection of the open ends 27 and 29 of the first housing portion 14 is provided with an aperture 40 adapted to receive a pivot pin 50 therethrough. Similarly, the side wall 32 of housing portion 16 is provided with an aperture 42 likewise adapted to receive the pivot pin 50 therein. In like manner, the side wall 24 is provided with an aperture 44 and side wall 34 is provided with an aperture 46 which are both adapted to receive a pivot pin 52 therein. As best shown in FIG. 3, a pivot pin support 48 is secured to and extends upwardly from the base 12. The support 48 is provided with an aperture 51 which registers with the apertures 44 and 46 in the side walls 24 and 34 respectively. A pivot pin 52 can then be slid through the registering apertures 44, 51 and 46 and secured in position by appropriate means. For instance, the pivot pin 52 shown in the drawing has an enlarged head portion 60 and a threaded end portion 62 which threadably engages a threaded locking nut 64. A pivot pin support 58 (not shown) substantially the same as support 48 is secured to the base so as to be disposed intermediate the side walls 22 and 32 of the housing portions 14 and 16 respectively, and such that the aperture 51 of support 48 is coaxially aligned with the aperture 61 of support 58. Thus the pivot pin 50 and the pivot pin 52 are aligned on the single axis 18.

A handle 70 is secured to the arcuate wall 26 near the edge adjacent to the open end 29 of the housing portion 14. Similarly, a handle 72 is secured to the arcuate wall 36 near the edge adjacent to the open end 39 of the housing portion 16. Thus, the housing portion 14 can be pivoted from its first position in which the open end 29 abuts against the top surface of the base 12 to a second pivotal position in which the open end 27 abuts against the upper surface of the base 12. Similarly, the housing portion 16 can be grasped by the handle 72 and pivoted from its first position in which the open end 39 abuts against the upper surface of the base 12 to its second pivotal position in which the open end 37 abuts against the upper surface of the base 12. Although as shown in the preferred embodiment illustrated in the drawing, the handles 70 and 72 protrude outwardly from the housing portions 14 and 16, it should be understood that they might also be recessed so as to permit the housing portions 14 and 16 to be interchanged from side to side.

Although the structure described above provides a sturdy protective enclosure for recreational vehicles, the preferred embodiment illustrated in the drawing also includes a sealing means which weatherproofs the enclosure and prevents rain or wind from leaking between the open ends 27 and 37 of the housing portions 14 and 16 respectively. The sealing means comprises an inwardly extending flange 76 disposed around the periphery of the open end 27 adjacent each side 22, 24, and 26. An outwardly extending flange 78 is disposed around the periphery of open end 37 adjacent each wall 32, 34, and 36. Intermediate the abutting surfaces of the flanges 76 and 78 is a pliable sealant 80. Preferably, the pliable sealant 80 is fixedly secured to the abutting surface of either flange 78 or 76 so that the sealant 80 remains in position when the abutting surfaces of the flanges 78 and 76 have been separated, as shown in phantom line in FIG. 2, when the housing portions 14 and 16 are pivoted relative to each other. In addition, sealing means (not shown) similar to the sealant 80 can be disposed along the edges of each open side 27, 29, 87 and 39.

Figure 2:
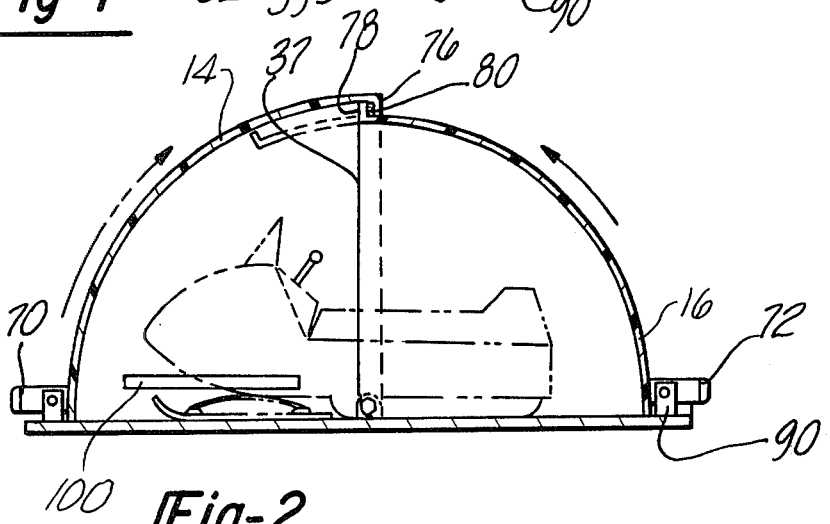
FIG. 2 is a side elevational view of the enclosure taken substantially along the line 2—2 in FIG. 1.

Preferably, locking means is provided for securing the housing portions 14 and 16 in their first pivotal position so that the sealed enclosure is locked in position. As best shown in FIGS. 1 and 2, the locking means illustrated in the preferred embodiment comprises a boss 90 extending upwardly from the base adjacent the outer edge of the open side 39 and adjacent the protruding handle 72. A pair of registering apertures are provided in the boss 90 and the handle 72 so that a locking pin (not shown) can be slidably engaged therein. Thus, the housing portion is restrained from pivoting from its first position to its second position.

An additional feature of the preferred embodiment of the present invention is shown in FIGS. 1 and 2. The housing portion 14 is provided with a pair of vents 100 on its side walls. The vents comprise downwardly sloping walls which define a downwardly facing opening. Such vents permit ventilation of the container while maintaining substantial protection of the contents from rain or road debris.

Since both housing portions 14 and 16 are pivotally secured to the base 12 about a single pivotal axis 18, the pivotal action of each portion 14 and 16 is substantially the same and thus only the operation of the housing portion 16 need be explained to illustrate the operation of the present invention. The present invention 10, is first lifted onto a trailer or truck bed and the base 12 positioned in an appropriate spot on the flat trailer or truck bed. It is conceivable that the base 12 would be anchored to the trailer to prevent relative movement between the trailer and the enclosure 10. Nevertheless, the locking pin is removed from the registering apertures in the boss 90 and the handle 72 so that the housing portion 16 becomes freely rotatable about the pivotal axis 18.

The operator then grasps the handle 72 lifting it upwardly to rotate the housing portion 16 about the pivotal axis 18. Thus, the housing portion 16 is telescopically received within the housing portion 14 such that the open end 39 of the housing 16 moves from its normal position in abutment with the top surface of the base 12 to an exposed position adjacent to the open end 27 of the housing portion 14 and the handle 72 engages the edge of the housing 14 at side 27. The enclosure is thus opened for easy entrance of a recreational vehicle which can be simply driven up a ramp onto the trailer and into the still locked housing portion 14.

After the vehicle has been driven into the housing portion 14, the operator can easily grasp the handle and rotate the housing portion 16 until the open end 39 again abuts against the upper surface of the base 12. At the same time, the flange 78 approaches the flange 76 and urges the sealing means 80 into abutting contact with the facing flange surfaces to provide a weatherproof seal between the housing portions 14 and 16. The locking pin can then be reinserted in the registering apertures in the boss 90 and handle 72 to prevent the housing portion 16 from opening when subjected to accelerative forces, wind forces or the like.

It is to be understood that although the present invention has been described with respect to its use as a recreational vehicle enclosure, an embodiment for which it is especially well adapted, the present invention is also well suited for enclosing other articles which would normally be exposed to weather conditions and road debris when carried in an open trailer or truck bed. The enclosure of the present invention is especially advantageous for use with a trailer since the arcuate contour of the housing portions decreases the wind resistance which would normally be encountered when transporting exposed articles. Moreover, due to the rigidity and rounded shape of the enclosure of the present invention, no puddles or pools which could seep into the interior of the enclosure can be formed above articles enclosed therein.

Having thus described my invention, many modifications will become apparent to those skilled in the art to which it pertains without departing from the spirit of the invention or the scope as defined in the appended claims.

What is claimed is:

1. A recreational vehicle enclosure comprising, a unitary, substantially rigid base, a first housing portion and a second housing portion pivotally secured to said base around a single pivotal axis between, (a) a first position in which each of said housing portions extends across the base from the pivotal axis in the opposite direction from the other housing portion, and thereby forming a completely enclosed chamber, and (b) a second position in which said second housing portion is telescopically received in said first housing portion and both housings extend across the base from the pivotal axis in the same direction to thereby form a partially enclosed chamber;

wherein each housing portion comprises two spaced apart sector-shaped side walls and an arcuate wall secured to the curved edge of each sector-shaped side wall, thereby defining a housing portion having a first open side and a second open side adjacent said first open side;

handle means secured to at least one of said first and second housing portions, said handle means being secured near the edge of said arcuate wall adjacent said second open side; and locking means secured to said base for engaging said handle and to selectively secure said second open side against said base whereby said handle means can be used to pivot said at least one housing portion with respect to the base when said locking means is disengaged from said handle means, and whereby said handle can be used to lift the entire enclosure by, and integrally with, its rigid base when said locking means is engaged with said handle means.

2. The invention as defined in claim 1 wherein said first housing portion includes an inwardly extending flange at the edge of its first open side and said second housing portion includes an outwardly extending flange at the edge of its first open side, said inwardly and outwardly extending flanges being adapted to abut against each other when said housing portions are in said first pivotal position.

3. The invention as defined in claim 2 and further comprising sealing means secured to one of said flanges so as to extend between the abutting surfaces of said flanges and thereby provide a weatherproof seal between the housing portions when said housing portions are in said first pivotal position.

4. The invention as defined in claim 1 wherein said handle means is secured to said arcuate wall of said at least one housing portion.

* * * * *